US007121205B2

(12) United States Patent
Ono et al.

(10) Patent No.: US 7,121,205 B2
(45) Date of Patent: Oct. 17, 2006

(54) DEVICE FOR AND METHOD OF COUPLING SHAFTS, IMAGE FORMATION APPARATUS, PROCESS CARTRIDGE, AND BELT UNIT

(75) Inventors: Hiroshi Ono, Tokyo (JP); Kaoru Yoshino, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/798,425

(22) Filed: Mar. 12, 2004

(65) Prior Publication Data

US 2004/0179862 A1 Sep. 16, 2004

(30) Foreign Application Priority Data

Mar. 14, 2003 (JP) ..... 2003-069680
Sep. 1, 2003 (JP) ..... 2003-308860

(51) Int. Cl.
*B41F 1/34* (2006.01)
*G03G 15/00* (2006.01)

(52) U.S. Cl. ..... 101/480; 101/475; 399/167; 399/227; 399/279; 399/351; 464/39; 464/88; 464/136

(58) Field of Classification Search ..... 399/227, 399/279

See application file for complete search history.

(56) References Cited

U.S. PATENT DOCUMENTS 2,764,882 A * 10/1956 Bosworth ..... 464/39
2,952,143 A * 9/1960 Case ..... 464/88
3,528,263 A * 9/1970 Stern ..... 464/88
4,902,045 A * 2/1990 McGugan et al. ..... 285/24
5,070,366 A * 12/1991 Tsuchiya ..... 399/167
5,396,319 A * 3/1995 Tokuhashi et al. ..... 399/351
5,867,759 A 2/1999 Isobe et al.
5,983,060 A 11/1999 Namekata et al.
6,183,368 B1 * 2/2001 King et al. ..... 464/57
6,375,577 B1 * 4/2002 Smith et al. ..... 464/136
6,671,475 B1 * 12/2003 Katada et al. ..... 399/111
6,697,595 B1 2/2004 Kawagoe et al.
6,768,235 B1 * 7/2004 Tsujimoto et al. ..... 310/75 R
2003/0123904 A1 * 7/2003 Maeshima et al. ..... 399/167
2004/0151518 A1 * 8/2004 Mizoguchi ..... 399/167

FOREIGN PATENT DOCUMENTS

JP 63-008655 1/1988
JP 2001-100476 4/2001
JP 2002-357986 12/2002

* cited by examiner

*Primary Examiner*—Daniel J. Colilla
*Assistant Examiner*—Marvin P. Crenshaw
(74) *Attorney, Agent, or Firm*—Oblon, Spivak, McClelland, Maier & Neustadt, P.C.

(57) ABSTRACT

A shaft coupling device for coupling a first shaft and a second shaft together includes a grip unit to be attached to the first shaft and including a grip portion configured to grip the second shaft, the grip portion having an end with notches of a length being parallel with an axial direction of the first shaft. The shaft coupling device also includes a grip force acting unit to be attached to the second shaft and configured to cause a grip force for gripping the second shaft to act on the grip portion by moving the grip portion in a radial direction of the second shaft.

28 Claims, 7 Drawing Sheets

DEVICE FOR AND METHOD OF COUPLING SHAFTS, IMAGE FORMATION APPARATUS, PROCESS CARTRIDGE, AND BELT UNIT

CROSS-REFERENCE TO RELATED APPLICATIONS

The present document incorporates by reference the entire contents of Japanese priority documents, 2003-069680 filed in Japan on Mar. 14, 2003 and 2003-308860 filed in Japan on Sep. 1, 2003.

BACKGROUND OF THE INVENTION

1) Field of the Invention

The present invention relates to a technology for coupling a shaft to another shaft.

2) Description of the Related Art

In image formation apparatuses, it is required to rotate with high-precision a photosensitive member (a rotating member) carrying an image to obtain images of high-quality. In particular, rotation of high-precision is important in the tandem type full color image formation apparatus. The tandem type full color image formation apparatus includes a plurality of photosensitive members each onto which an image of a different color is formed. Each of the images formed on the photosensitive members are then transferred onto an intermediate transfer belt or a transfer sheet directly with the images being superimposed onto one another to obtain a full color image. Therefore, the rotation of high-precision is required to prevent the full color image from being out of color registration.

A motor of high-precision may be used to improve the precision of rotation of the rotating member in the tandem type full color image formation apparatus. However, even if the motor of high-precision is used, if the central axes of the rotating shaft of the motor and the shaft supporting the photosensitive member are displaced from each other at a position in which the shafts are coupled, the rotation of the photosensitive member becomes non-uniform. As a result, deterioration in image quality caused by unevenness of the image called banding or a positional deviation in a sub-scanning direction of the photosensitive member on the surface of the photosensitive member is caused.

A conventional shaft coupling device for coupling a rotating shaft supporting -a photosensitive member and a shaft of a motor rotating the rotating shaft is described in a Japanese Patent Application Laid-Open No. 2002-357986 (see page 4 and FIGS. 7 to 9). A motor is fixed to an image formation apparatus by the shaft coupling device. That is, a flange is attached to the rotating shaft of the photosensitive body. A drum coupling unit having a notch is attached to the shaft of the motor. A spring pin is fixed to the rotating shaft such that the spring pin protrudes from the rotating shaft in a radial direction of the rotating shaft. The flange is fitted with the drum coupling unit and the spring pin with the notch of the drum coupling unit. Screws are then inserted into four holes provided on the motor to fix the motor to the image formation apparatus.

According to the shaft coupling device, the rotating shaft of the photosensitive member and the shaft of the motor are coupled to each other by fitting of the spring pin attached to the rotating shaft into the notch of the drum coupling unit. In other words, the coupling between the shafts is not highly precise because the rotating shaft of the photosensitive member and the shaft of the motor are not completely integrated with each other. Consequently, there is a possibility that the central axes of the coupled shafts may be displaced from each other.

SUMMARY OF THE INVENTION

It is an object of the present invention to solve at least the problems in the conventional technology.

A shaft coupling device according to an aspect of the present invention couples a first shaft and a second shaft together, and includes a grip unit to be attached to the first shaft and including a grip portion configured to grip the second shaft, the grip portion having an end with notches of a length being parallel with an axial direction of the first shaft and; and a grip force acting unit to be attached to the second shaft and configured to cause a grip force for gripping the second shaft to act on the grip portion by moving the grip portion in a radial direction of the second shaft.

A shaft coupling device according to another aspect of the present invention couples a first shaft and a second shaft, and includes a grip unit including a parallel surface parallel with a central axis of the first shaft and configured to grip the second shaft by abutting the parallel surface on the second shaft; and a grip force acting unit configured to cause a grip force for gripping the second shaft to act on the parallel surface, wherein the grip force acting unit moves along an outer peripheral surface of the grip unit in parallel with a central axis of the second shaft to change a pressure acting on the grip unit, and the parallel surface of the grip unit is caused to abut on an outer peripheral surface of the second shaft by the pressure to grip the second shaft.

An image formation apparatus according to still another aspect of the present invention includes a rotating member supporting shaft configured to support a rotating member an output shaft of a motor configured to rotate the rotating member supporting shaft; and a shaft coupling device configured to couple the rotating member supporting shaft and the output shaft, and includes a grip unit having a grip portion to be attached to one of the rotating member supporting shaft and the output shaft to grip another one of the rotating member supporting shaft and the output shaft, and a grip force acting unit to be attached to the another one to cause a grip force for gripping the another one to act on the grip portion by moving the grip portion in a radial direction of the another one.

A process cartridge according to still another aspect of the present invention, which is to be mounted in the image formation apparatus according to the above aspect, includes a drum-shaped photosensitive member as the rotating member, wherein the process cartridge includes the photosensitive member integrally assembled with at least one of a charging device, a developing device, and a cleaning device for cleaning a surface of the photosensitive member, and is attachable to and detachable from the image formation apparatus when the rotating member supporting shaft is still being attached to the image formation apparatus.

A belt unit according to still another aspect of the present invention, which is to be mounted in the image formation apparatus according to the above aspect, is characterized in that the rotating member supporting shaft includes a rotating engagement member integral with the rotating member supporting shaft and engaged with the rotating member to rotate integrally with the rotating member, and a bearing configured to rotatably support the rotating member supporting shaft, and the rotating member is attachable to and detachable from the rotating member supporting shaft, the rotating member is a belt supporting member configured to support a belt so as to allow conveyance of the belt, the rotating member supporting shaft is fixed to the image formation apparatus, and the belt supporting member is attachable to and detachable from the rotating member supporting shaft.

An image formation apparatus according to still another aspect of the present invention includes a rotating member supporting shaft configured to support a rotating member; an output shaft of a motor configured to rotate the rotating member supporting shaft; and a shaft coupling device configured to couple the rotating member supporting shaft and the output shaft, and includes a grip unit including a parallel surface parallel with a central axis of the output shaft and configured to grip the rotating member supporting shaft by abutting the parallel surface on the rotating member supporting shaft, and a grip force acting unit configured to cause a grip force gripping the rotating member supporting shaft to act on the parallel surface, wherein the grip force acting unit moves along an outer peripheral surface of the grip unit in parallel with a central axis of the output shaft to change a pressure acting on the grip unit, and the parallel surface of the grip unit is caused to abut on an outer peripheral surface of the rotating member supporting shaft by the pressure to grip the rotating member supporting shaft.

A shaft coupling method according to still another aspect of the present invention, which is of coupling a first shaft and a second shaft, includes the steps of screwing for a first distance a first screw portion of a grip unit having a grip portion and provided at an end of the first shaft to grip the second shaft onto a second screw portion of a grip force acting unit configured to cause a grip force for gripping the second shaft to act on a grip portion by moving the grip portion in a radial direction of the first shaft; engaging the second shaft with the grip force acting unit such that the second shaft is not rotatable relatively to the grip force acting unit when the first and second screw portions have been screwed onto each other for the first distance; screwing the first and second screw portions onto each other further for a second distance from the first distance by rotating the second shaft and restricting rotation of the first shaft to cause the grip force acting unit to move the grip portion in the radial direction such that the grip portion grips the second shaft.

A shaft coupling method according to still another aspect of the present invention, which is of coupling a first shaft and a second shaft, includes abutting a parallel surface of a grip unit on an outer peripheral surface of the second shaft, the parallel surface being parallel with a central axis of the first shaft and configured to grip the second shaft; and moving a grip force acting unit configured to cause a grip force for gripping the second shaft to act on the parallel surface, along an outer peripheral surface of the grip unit in parallel with a central axis of the second shaft to change a pressure acting on the grip unit.

The other objects, features, and advantages of the present invention are specifically set forth in or will become apparent from the following detailed descriptions of the invention when read in conjunction with the accompanying drawings.

DETAILED DESCRIPTION

Exemplary embodiments of the present invention are described below with reference to the accompanying drawings.

Figure 1:
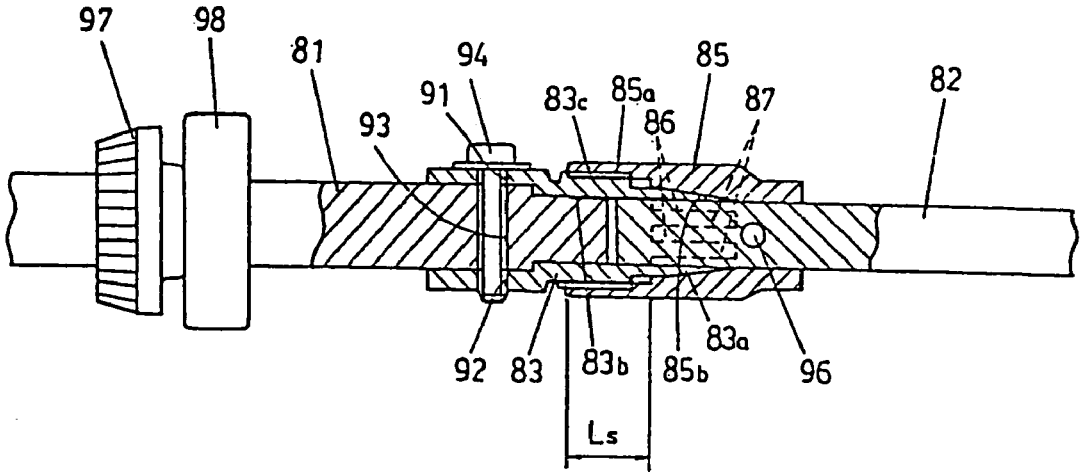
FIG. 1 is a cross sectional view of a first shaft and a second shaft coupled to each other by a shaft coupling device according to an embodiment of the present invention.
Figure 2:
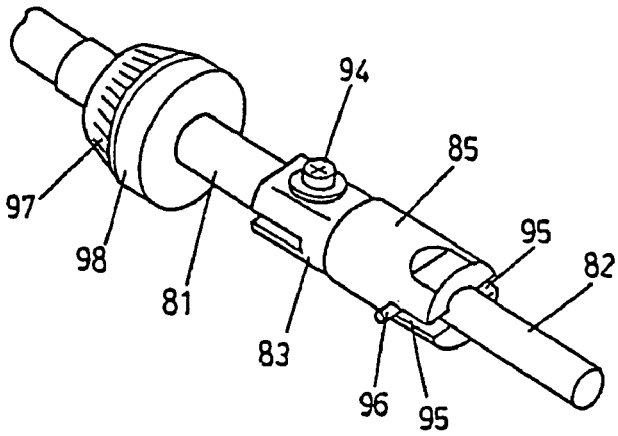
FIG. 2 is a perspective view of the first and second shafts.
Figure 3:
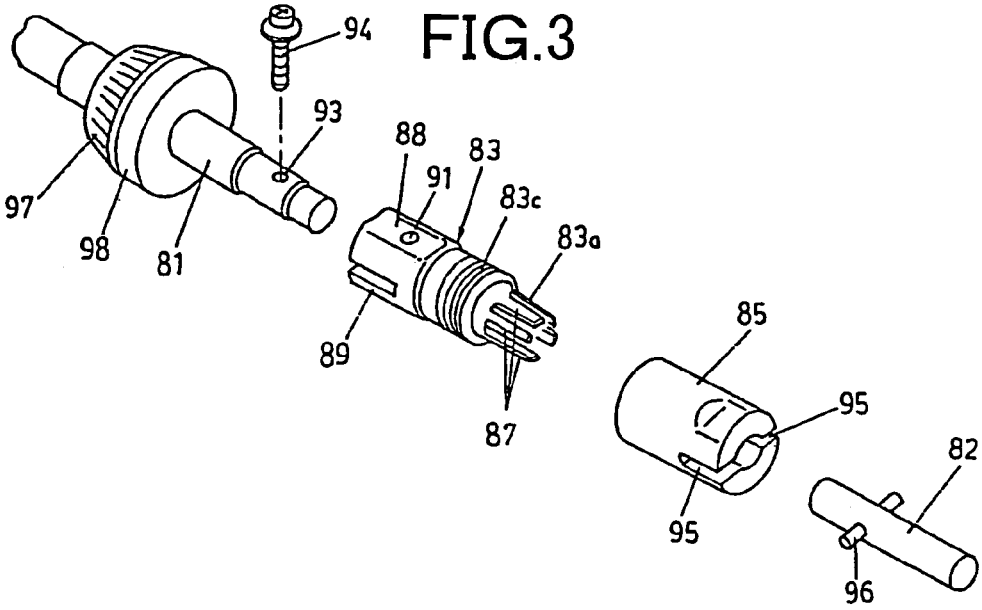
FIG. 3 is an exploded perspective view of the first and second shafts before the coupling.

FIG. 1 is a sectional view of a first shaft and a second shaft coupled to each other by a shaft coupling device according to an embodiment of the present invention. FIG. 2 is a perspective view of the first and second shafts. FIG. 3 is an exploded perspective view of the two shafts before being coupled to each other.

The shaft coupling device couples a rotating shaft 81, which is the first shaft, with a rotating drive shaft 82, which is the second shaft. The shaft coupling device includes a grip member 83 which is a grip unit provided to the rotating shaft 81 and having a grip portion 83*a* on an end of the grip member to grip the rotating drive shaft 82. The shaft coupling device further includes a grip force acting member 85 which is a grip force acting unit provided to the rotating drive shaft 82 to cause a grip force for gripping the rotating drive shaft 82 to act on the grip portion 83*a* by moving the grip portion 83*a* in a radial direction of the rotating shaft 81. The grip portion 83*a* includes a plurality of split grip portions 87 split in a circumferential direction of the grip portion 83*a* and a plurality of slits 86. That is, the grip portion 83*a* has an end with the slits 86 or notches having a length in an axial direction of the rotating shaft and being parallel to the axial direction The grip member 83 may be provided to the rotating drive shaft 82 which is the second shaft and the grip force acting member 85 to the rotating shaft 81 which is the first shaft, instead.

The grip member 83 having a shape as illustrated in FIG. 3, also includes on another end of the grip member 83 opposite surfaces 88 and 89 formed by cutting off portions of the grip member 83, and screw holes 91 and 92 penetrating the opposite surfaces 88 and 89, as illustrated in FIG. 1. A through hole 93 corresponding to the screw holes 91 and 92 is formed in the rotating shaft 81. A screw 94 is screwed into the screw holes 91, 92 and the through hole 93. The screw 94 penetrating the screw holes 91, 92, and the through hole 93 fixes the rotating shaft 81 and the grip member 83 to be integral with each other. That is, the grip member 83 is detachably attached to the rotating shaft 81. When the grip portion 83 is fixed to the rotating shaft 81, an end of the rotating shaft 81 is approximately at an intermediate position of a fitting hole portion 83*b* formed in an axial direction of the grip member 83.

The fitting hole portion 83*b* includes a shaft center holding portion Ls about the intermediate position. The shaft center holding portion Ls has an accurate inner diameter with an axial center of the shaft center holding portion Ls exactly matching central axes of the shafts 81 and 82. The shaft center holding portion Ls is positioned at a distance away from a tip of the end of the grip potion 83*a*, the distance being greater than the length of the slits 86. That is, the shaft center holding portion Ls is located on a left-hand side of the split grip portions 87 in the embodiment illustrated in FIG. 1. The shaft center holding portion Ls is thus a portion of the grip member 83.

When the grip force acting member 85 is moved towards the grip member 83, the grip force acting member 85 abuts on the grip portion 83*a* of the grip member 83 to move the grip portion 83*a* in the radial direction, thereby causing the grip force to act on the grip portion 83*a*.

As illustrated in FIG. 3, the grip force acting member 85 is approximately cylindrical and includes grooves 95 having the same depth at two positions opposed to each other. A pin 96 pierced through and fixed to an end portion of the rotating drive shaft 82 in the radial direction fits within the grooves 95.

The grip force acting member 85 has a female screw portion 85*a* on an inner peripheral surface of the grip force acting member 85, the inner peripheral surface surrounding the grip member 83, as illustrated in FIG. 1. The grip member 83 has a male screw portion 83*c* corresponding to the female screw portion 85*a*. When these screw portions are screwed onto each other, the grip force acting member 85 is moved towards the grip member 83.

The split grip portions 87 of the grip member 83 contacting with the grip force acting member 85 are each tapered such that the grip force is evenly applied to the split grip portions 87 from around a circumference of the-split grip portions 87. When the grip force acting member 85 is moved toward the grip member 83, a tapered surface 85*b* on an inner surface of the grip force acting member 85 abuts on the split grip portions 87 so that the split grip portions 87 are moved in the radial direction to which the split grip portions 87 grip the rotating drive shaft 82. That is, the split grip portions 87 are moved in a direction to which an inner diameter of the split grip portions 87 is reduced.

In FIG. 1, a rotating member engagement member is designated by a reference numeral 97, and a bearing by a reference numeral 98.

When the rotating shaft 81 and the rotating drive shaft 82 are coupled by the shaft coupling device, the female screw portion 85*a* formed on the grip force acting member 85 is screwed onto the male screw portion 83*c* formed on the grip member 83 for a first distance.

The pin 96 fixed to the rotating drive shaft 82 is then engaged with the grooves 95 (see FIGS. 2 and 3) of the grip force acting member 85 so as not to be relatively rotatable to each other as illustrated in FIG. 2. Rotation of the rotating shaft 81 is restricted when the rotating drive shaft 82 is next rotated in a direction to which the male screw portion 83*c* and the female screw portion 85*a* are screwed further onto each other from the first distance for a second distance.

Consequently, since the grip force acting member 85 moves toward the grip member 83 (toward the left-hand side in FIG. 1) and the tapered surface 85*b* of the grip force acting member 85 moves the split grip portions 87 of the grip portion 83*a* in the radial direction, the grip portion 83*a* grips the rotating drive shaft 82 securely and firmly.

A rotating force is transmitted from the rotating drive shaft 82 to the grip force acting member 85, the grip member 83, and the rotating shaft 81, via the pin 96 with looseness caused in a gap between the pin 96 and the grooves 95, when the male screw portion 83*c* and the female screw portion 85*a* have been screwed onto each other for the first distance.

However, when the male screw portion 83*c* and the female screw portion 85*a* have been screwed further for the second distance, the grip force acting member 85 moves the grip portion 83*a* in the radial direction to which the inner diameter is reduced, so that the grip portion 83*a* is firmly fixed to and integrated with the rotating drive shaft 82. Consequently, a torque is transmitted via an integrated portion of the grip portion 83*a* and the rotating drive shaft 82. As a result, the rotating force is shifted from the pin 96 to a portion at which the grip force acting member 85 and the grip portion 83*a* grip the rotating drive shaft 82. Therefore, the looseness caused in the gap between the pin 96 and the grooves 95 no longer causes uneven transmission of the torque, and the rotating shaft 81 and the rotating drive shaft 82 can be coupled securely with the central axes of the shafts 81 and 82 accurately coinciding or being coaxial to each other.

Therefore, according to the shaft coupling device, the grip force acting member 85 is engaged with the rotating drive shaft 82 by inserting the pin 96 having ends protruding from a surface of the rotating drive shaft 82, into the grooves (notched grooves) 95 formed in the grip force acting member 85. The rotating force from the rotating drive shaft 82 to the rotating shaft 81 is first transmitted through the pin 96 and then the grooves 95. After the male screw portion 83*c* and the female screw portion 85*a* have been screwed onto each other for the second distance, the rotating force shifts directly to the rotating drive shaft 82 and the grip portion 83*a* gripping the rotating drive shaft 82.

As illustrated in FIG. 1, when the rotating shaft 81 has been coupled to the rotating drive shaft 82, the central axes of the rotating shaft 81 and the rotating drive shaft 82 accurately coincide with each other because the end portion of the rotating drive shaft 82 is integrated with the rotating shaft 81 with the end portion being inserted up to the shaft center holding portion Ls of the fitting hole portion 83*b* in the grip member 83.

Further, since the grip portion 83*a* of the grip member 83 gripping the rotating drive shaft 82 has the split grip portions 87 which are tapered such that thickness of the split grip portions 87 becomes thinner toward ends of the split grip portions 87, the grip force is applied evenly to the rotating drive shaft 82 from around the circumference of the slit grip portions 87. Therefore, the grip force that is stable is generated.

Furthermore, since the grip member 83 is fixed to the rotating shaft 81 with the screw 94 so that the grip member 83 is integrated with the rotating shaft 81, deviation between the grip member 83 and the rotating shaft 81 can be reduced.

If the grip member 83 is attached to the rotating drive shaft 82 instead of the rotating shaft 81, the grip member 83 may be similarly structured integrally with the rotating drive shaft 82.

Figure 4:
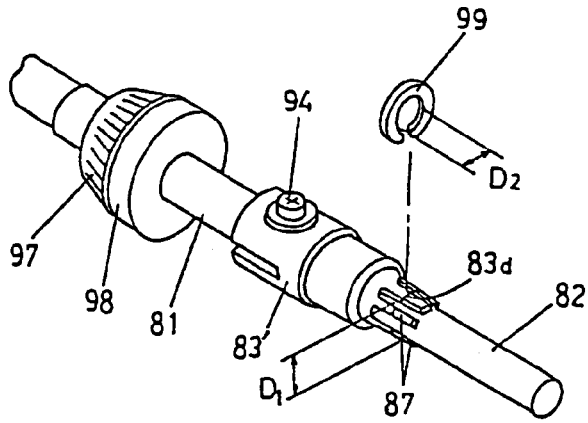
FIG. 4 is a sectional view of a first shaft and a second shaft coupled to each other by a shaft coupling device according to another embodiment of the present invention.

FIG. 4 is a perspective view similar to FIG. 2, of a shaft coupling device according to another embodiment of the present invention. Parts corresponding to those of FIG. 2 are designated with the same reference numerals.

This shaft coupling device is different from the shaft coupling device of the previous embodiment only in that a C-shaped ring (a clamp member) 99 fastening a grip portion of a grip member 83' which is a grip unit, from around an outer periphery of the grip portion, is used as the grip force acting unit.

In this shaft coupling device, a ring fitting groove 83*d* into which the C-shaped ring 99 is fitted is formed on an outer peripheral surface of slit grip portions 87 of the grip member 83'. A groove diameter $D_1$ of the ring fitting groove 83*d* is greater than an inner diameter $D_2$ of the C-shaped ring 99.

Therefore, when the C-shaped ring 99 is fitted in the ring fitting groove 83*d*, an outer diameter defined by the split grip portions 87 is decreased due to an elastic force of the C-shaped ring 99. Consequently, the split grip portions 87 firmly grip the rotating drive shaft 82, thereby coupling the rotating drive shaft 82 and the rotating shaft 81 to be integral with each other.

The rotating shaft 81 and the rotating drive shaft 82 can be securely coupled such that their axes are precisely coaxial to each other. Moreover, according to this embodiment, the C-shaped ring 99 which fastens the outer periphery of the grip portion can be detached easily.

Figure 5:
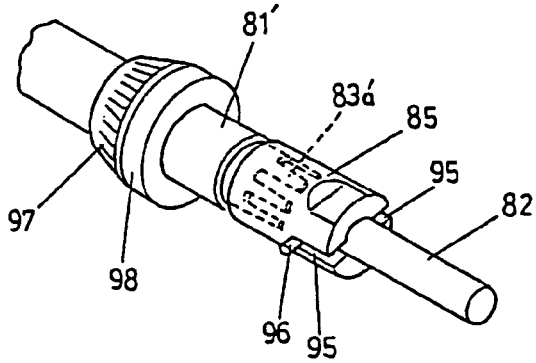
FIG. 5 is a perspective view of a first shaft and a second shaft coupled by a shaft coupling device according to still another embodiment of the present invention.

FIG. 5 is a perspective view similar to FIG. 2, of a shaft coupling device according to still another embodiment of the present invention. Parts corresponding to those of FIG. 2 are designated with the same reference numerals.

This shaft coupling device is different from the shaft coupling device of FIG. 2 only in that a grip portion 83*a'* is integrally formed at an end portion of a rotating shaft 81'. That is, the grip portion 83*a'* is a part of the rotating shaft 81'.

According to this shaft coupling device, any error caused in assembling related to coupling between the rotating shaft 81' and the grip portion 83*a'* is avoided, and thus central axes of the rotating shaft 81' and the rotating drive shaft 82 coincide with each other even more precisely.

An embodiment of an image formation apparatus according to the present invention is explained below.

Figure 6:
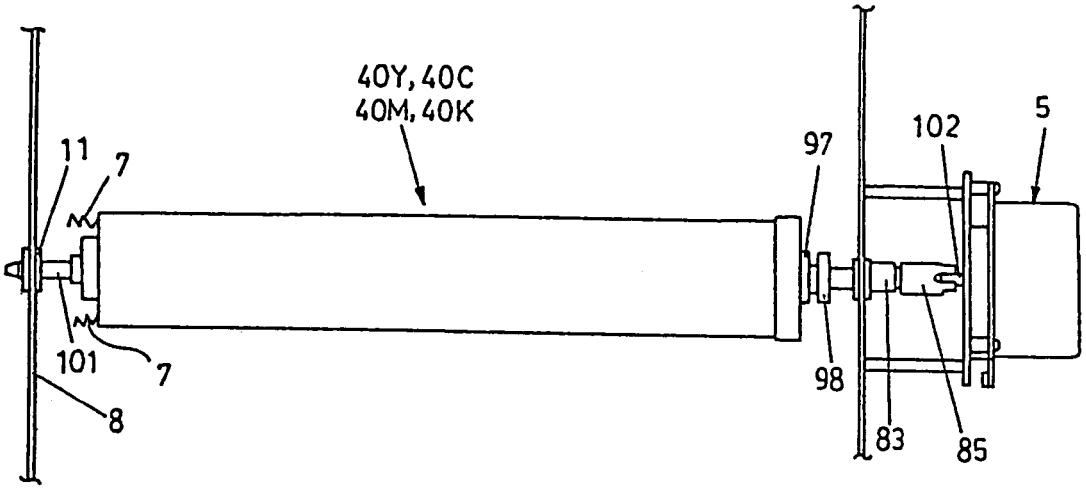
FIG. 6 is an illustration of a photosensitive member and a drive system of an image formation apparatus according to still another embodiment of the present invention, which are viewed from a side of the image formation apparatus.
Figure 7:
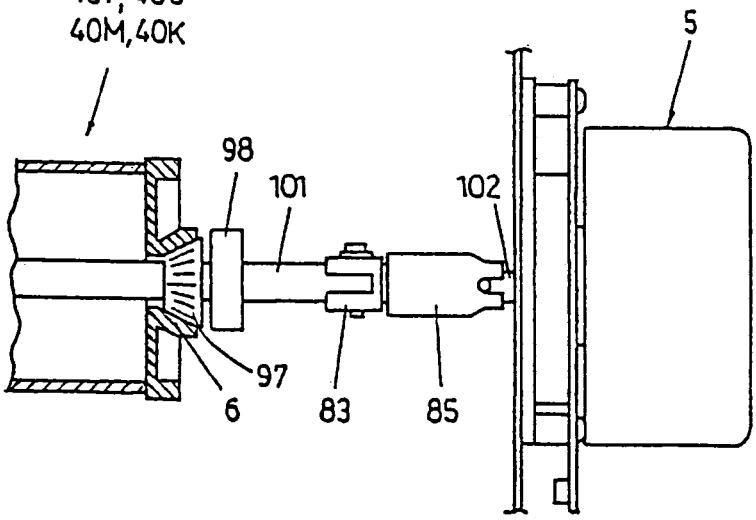
FIG. 7 is an enlarged illustration of the coupling between the photosensitive member and the drive system.
Figure 8:
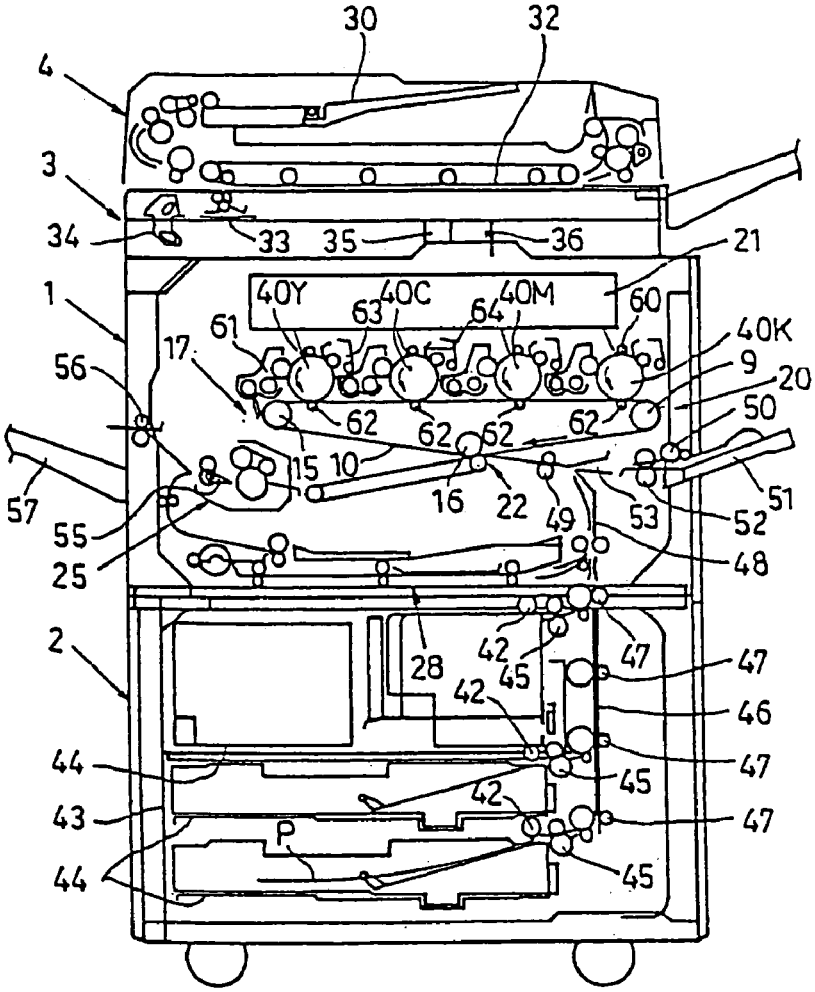
FIG. 8 is an illustration of a configuration of the image formation apparatus.

FIG. 6 is an illustration of a photosensitive member and a drive system of the image formation apparatus, which are viewed from a lateral side of the image formation apparatus. FIG. 7 is an enlarged view about a position at which a shaft of the photosensitive member is coupled to a shaft of the drive system. FIG. 8 is an illustration of a configuration of the image formation apparatus. Parts corresponding to those of FIGS. 1 and 2 are designated with the same reference numerals.

The image formation apparatus is an example of a color copying machine including an intermediate transfer belt 10 which is rotated as the intermediate transfer belt 10 carries an image.

In the color copying machine, when a color image is reproduced or copied, an original document (hereinafter, "original") is set on a platen 30 of an automatic document feeder 4. If the original is to be set manually, the automatic document feeder 4 is opened, and the original is set on a contact glass 32 of a scanner 3 and the automatic document feeder 4 is closed to press the original on the contact glass 32.

When the original has been set in the automatic document feeder 4 and a start switch (not illustrated) is pressed, the original is fed onto the contact glass 32. If the original has been set on the contact glass 32 manually, the scanner 3 is immediately driven-so that a first running member 33 and a second running member 34 start running. Light from a light source of the first running member 33 is irradiated on the original, and the light reflected from a surface of the original is directed to the second running member 34 and reflected by a mirror of the second running member 34 to be incident on a reading sensor 36 through an imaging lens 35, so that the original is read.

When the start switch is pressed, an intermediate transfer belt 10 of an intermediate transfer apparatus 20 starts to rotate. Simultaneously, photosensitive members 40Y, 40C, 40M, and 40K start to rotate as well to form monochromatic images of yellow, cyan, magenta, and black respectively on the photosensitive members using charging devices 60, exposing devices 21, developing devices 61, first transfer devices 62, photosensitive member cleaning devices 63, and charge eliminating devices 64. The monochromic images formed on the respective photosensitive members are sequentially transferred onto the intermediate transfer belt 10 rotating in a clockwise direction in FIG. 8 to be superimposed on one another so that a composite color image of a full color is formed on the intermediate transfer belt 10.

The intermediate transfer belt 10 is rotatably wound with a tension, around a belt drive roller 9, and driven rollers 15 and 16.

When the start switch is pressed, a sheet feeding roller 42 in a sheet feeding stage selected from a sheet feeding table 2 starts to rotate so that a sheet P is fed out from a sheet feeding cassette 44 selected from a paper bank 43. The sheet P is separated from a sheet stack by a separation roller 45 to be conveyed to a sheet feeding path 46.

The sheet P is then conveyed by a conveying roller 47 to a sheet feeding path 48 in a main body of the copying machine 1 to abut on a resist roller 49 where the sheet P is stopped.

If a sheet P is to be fed manually, the sheet P set on a manual feeding tray 51 is fed out by rotation of a sheet feeding roller 50, is separated from a sheet stack by a separating roller 52 to be conveyed to a manual sheet feeding path 53, and abuts on the resist roller 49 where the sheet P is stopped.

The resist roller 49 starts to rotate at an accurate timing matching with the composite color image formed on the intermediate transfer belt 10 to feed the sheet P that has been stopped into between the intermediate transfer belt 10 and a secondary transfer device 22. The composite color image is then transferred onto the sheet P by the secondary transfer device 22.

The sheet P with the image transferred thereon is conveyed to a fusing or fixing device 25 by the secondary transfer device 22, which also functions as a conveying device. The fixing device 25 applies heat and pressure to the sheet P to fix the image onto the sheet P. The sheet P is next guided by a switching claw 55 to be ejected onto an output tray 57 by an ejection roller 56 to be stacked on the output tray 57.

If a duplex copying mode is selected, a sheet P with an image formed on one side of the sheet P is conveyed to a sheet reversing device 28 by the switching claw 55. The sheet P is reversed and guided to where another image is transferred onto another side of the sheet P, and then ejected onto the output tray 57 by the ejection roller 56.

After the transfer of image onto the sheet P, a surface of the intermediate transfer belt 10 is cleaned by the cleaning device 17.

In the color copying machine, a first shaft, which is a rotating member engagement shaft 101 (corresponding to the rotating shaft 81 in FIG. 1) illustrated in FIG. 7 for supporting any one of the four photosensitive members 40, and a second shaft, which is a rotating drive shaft 102 (corresponding to the rotating drive shaft 82 in FIG. 1) of a motor 5 are coupled in the same way as that illustrated in any one of FIGS. 1 to 4. Therefore, the way they are coupled will not be described here to avoid redundant explanation.

Each photosensitive member 40 includes a flange at an end portion in an axial direction of the photosensitive member 40, and the flange has a conical portion 6, as illustrated in FIG. 7. A rotating member engagement member 97 is attached to the rotating member engagement shaft (rotating shaft) 101 so as to correspond to the conical portion. A bearing 98 which rotatably supports the photosensitive member 40 is attached to the rotating member engagement shaft 101.

Each photosensitive member 40 is biased toward the rotating member engagement member 97 via an intermediate member (not illustrated) by a biasing spring 7 provided at an end surface on a left-hand side in FIG. 6 with the rotating member engagement shaft 101 being fitted into the photosensitive member 40 along a central axis of the photosensitive member 40, as illustrated in FIG. 6.

Consequently, as illustrated in FIG. 7, the conical portion 6 is pressed onto the rotating member engagement member 97 fixed to the rotating member engagement shaft 101 to be engaged with the rotating member engagement member 97, and the photosensitive member 40 is thus integrated with the rotating member engagement shaft 101 to be rotatable without being loose.

An end portion of the rotating member engagement shaft, the end portion opposite to a side of the rotating member engagement shaft, the side at which the rotating member engagement member 97 is attached, is rotatably supported by a main frame 8 of the color copying machine via a bearing 11, as illustrated in FIG. 6. In the color copying machine, each of four photosensitive members 40 is supported in this same manner and rotated by a respective one of motors 5.

The rotating member engagement shaft 101 and the rotating drive shaft 102 of each motor 5 are coupled to each other as described with reference to FIGS. 1 to 3. The motor 5 according to this embodiment is of a direct drive type which does not have a reduction mechanism.

Accordingly, uneven rotation due to a variation in accuracy of the reduction mechanism can be avoided and thus a deviation in a sub-scanning direction of an image that may be caused by the uneven rotation of the photosensitive member 40 can be prevented, in contrast to an example in which a motor of a type which outputs a rotational force via a reduction gear.

A forward rotating direction of the motor 5 is in a direction opposed to a rotating direction in which the male screw portion 83*c* of the grip member 83 is screwed off from the female screw portion 85*a* of the grip force acting member 85 explained with reference to FIG. 1 when the motor is rotated.

Accordingly, the grip force acted on the rotating drive shaft 102 by the grip portion 83*a* will not be decreased even if the motor 5 is rotated in the forward rotating direction after the rotating member engagement shaft 101 and the rotating drive shaft 102 are coupled by the shaft coupling device.

As described above, the color copying machine includes a rotating member supporting shaft, which is the rotating member engagement shaft 101 supporting a rotating member, which is the photosensitive member 40 that is drum-shaped, an output shaft of the motor 5 which is the rotating drive shaft 102 that rotates the rotating member engagement shaft 101, and the shaft coupling device that couples the rotating member engagement shaft 101 and the rotating drive shaft 102 of the motor 5.

Since the shaft coupling device includes the grip member 83 to be attached to the rotating member engagement shaft 101 and having the grip portion 83*a* which grips the rotating drive shaft 102, and the grip force acting member 85 to be attached to the rotating drive shaft 102 to cause the grip force for gripping the rotating drive shaft 102 to act on the grip portion 83*a* by moving the grip portion 83*a* in the radial direction, the rotating member engagement shaft 101 and the rotating drive shaft 102 can be integrated with each other with the central axes of the shafts 101 and 102 coinciding with each other with a remarkably high precision.

As a result, since the uneven rotation of each photosensitive member 40 can be prevented, an image of high-quality can be obtained.

Moreover, similar effects can be achieved if the grip portion is attached to the rotating drive shaft 102 and the rotating member engagement shaft 101 is gripped by the grip portion.

What is more, according to this embodiment, maintenance and thus services related to the image formation apparatus can be facilitated, because the rotating member engagement member 97 engaged with the photosensitive member 40 to integrally rotate with the photosensitive member 40 is provided integrally with the rotating member engagement shaft 101, the bearing 98 for rotatably supporting the rotating member engagement shaft 101 is provided, and the photosensitive member 40 is attachable to and detachable from the rotating member engagement shaft 101.

Furthermore, similar effects can be achieved if the shaft coupling device explained with reference to FIG. 4 or 5 is used to couple the rotating member engagement shaft 101 and the rotating drive shaft 102 for this embodiment.

Figure 9:
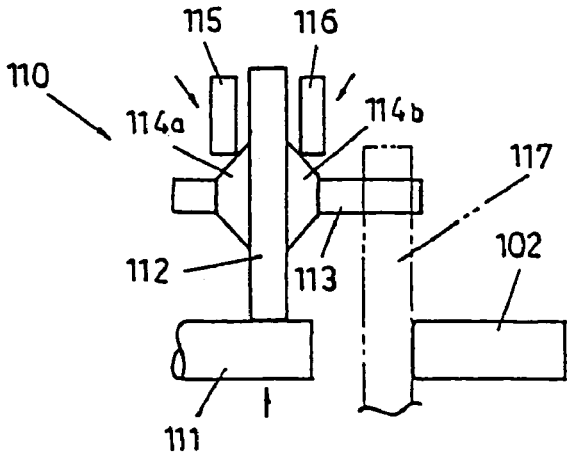
FIG. 9 is an illustration of a reduction mechanism of a motor which rotates a rotating drive shaft of an image formation apparatus according to still another embodiment of the present invention.

FIG. 9 is an illustration of a reduction mechanism for a motor that rotates a rotating drive shaft of an image formation apparatus according to still another embodiment of the present invention.

Since a basic configuration of the image formation apparatus in this embodiment is similar to that of FIG. 8, illustration of the whole apparatus will be omitted.

The motor for decelerating and driving the rotating drive shaft 102 in this embodiment includes a planetary roller reduction device 110. Only a main configuration of the planetary roller reduction device 110 is illustrated in FIG. 9.

The planetary roller reduction device 110 presses a rotating shaft 111 of a motor, which is, for example, a direct current (DC) motor against an outer peripheral surface of a reduction roller 112 which is rotatably supported.

The reduction roller 112 has a reduction roller shaft 113 at its rotational center, and ring receivers 114*a* and 114*b* are respectively formed integrally with the reduction roller on surfaces of the reduction roller 112 in the vicinity of a position at which the reduction roller shaft 113 is fixed to the reduction roller 112. Rings 115 and 116 are pressed onto the ring receivers 114*a* and 114*b* respectively.

The reduction roller shaft 113 rotates a disc 117 integral with a final output shaft, which is the rotating drive shaft 102, so that the rotating drive shaft 102 is rotated.

An outer diameter of the rotating shaft 111 of the motor is significantly smaller than an outer diameter of the reduction roller 112. Accordingly, rotation of the rotating drive shaft 102 is decelerated.

In other words, the planetary roller reduction device 110 decelerates the rotating drive shaft 102 by using the pressure of the roller and without any gears in the reduction mechanism.

As a result, smooth rotation at a constant velocity can be achieved, and noise level and vibration can be reduced. Therefore, by decelerating and driving the rotating drive shaft 82 with the motor included in the planetary roller reduction device 110, uneven rotation can be even more avoided, so that deviation in the sub-scanning direction of the image due to the uneven rotation of the photosensitive member can be prevented.

Figure 10:
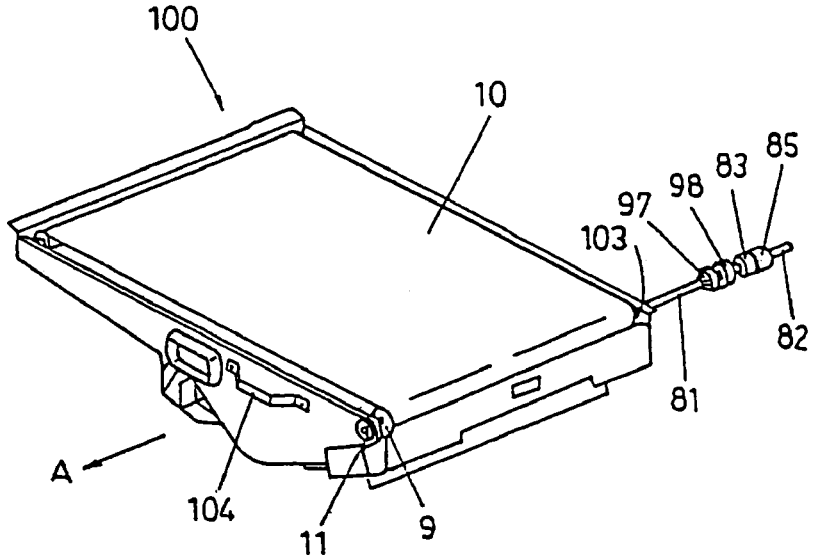
FIG. 10 is a perspective view of a belt unit of an image formation apparatus according to still another embodiment of the present invention.

FIG. 10 is a perspective view of a belt unit of an image formation apparatus according to still another embodiment of the present invention. Since a basic configuration of the image formation apparatus is similar to that of FIG. 8, illustration of the image formation apparatus will be omitted and explanation will be made with reference numerals used in FIG. 8.

The belt unit 100, has a rotating member which is a belt supporting member or a belt drive roller 9 which supports the intermediate transfer belt 10 so as to allow traveling of the intermediate transfer belt 10. Any one of the shaft coupling devices of FIGS. 1 to 5 may be used for coupling and driving of the rotating shaft 81 integrated with the belt drive roller 9 and the rotating drive shaft 82 of a motor. Since the coupling and driving are similar to those explained with reference to FIGS. 1 to 3, detailed explanation of the coupling and driving will be omitted.

The belt drive roller 9 is engaged with a rotating member engagement member 97 integrated with the rotating shaft 81 via a flange 103 formed on an end of the belt drive roller 9 and corresponding to the rotating member engagement member 97. The belt drive roller 9 rotates integrally with the rotating shaft 81.

In FIG. 10, the rotating shaft 81 is in a state in which the rotating shaft 81 has been pulled out partway from the belt drive roller 9 for convenience of explanation.

The rotating shaft 81 functioning as the rotating member supporting shaft is fixed to a main body of the image formation apparatus, and the belt drive roller 9 is attachable to and detachable from the rotating shaft 81.

The belt drive roller 9 is supported by a bearing 98 attached to the rotating shaft 81 in the vicinity of the rotating member engagement member 97, such that the belt drive roller 9 is freely rotatable.

The belt unit 100 can be readily attached to and detached from the main body by pulling a handle 104 fixed integrally with a frame surface of the belt unit 100 toward a front of the image formation apparatus in a direction indicated by an arrow A.

According to the belt unit 100, since the rotating drive shaft 82 through which a rotating force is transmitted from the motor and the rotating shaft 81 of the belt drive roller 9 which drives the intermediate transfer belt 10 can be securely coupled without any looseness with axes of the shafts 81 and 82 precisely coinciding with each other, uneven rotation of the belt drive roller 9 can be prevented. Consequently, uneven rotation of the intermediate transfer belt 10 can be prevented, such that deviation in positions of differently colored images superimposed onto the intermediate transfer belt 10 can be prevented to obtain an image of high-quality.

Figure 11:
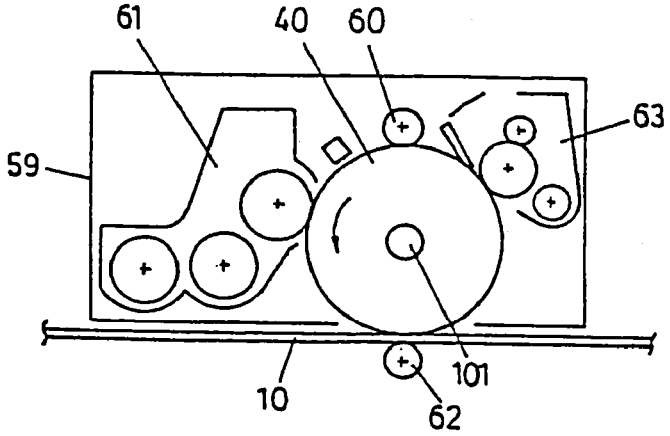
FIG. 11 is a schematic view of a configuration about a photosensitive body of an image formation apparatus according to still another embodiment of the present invention.

FIG. 11 is a schematic view of a configuration around a photosensitive member of an image formation apparatus according to still another embodiment of the present invention. Parts corresponding to those of FIG. 8 will be designated by the same reference numerals used in FIG. 8. Since a basic configuration of the image formation apparatus is similar to that of FIG. 8, illustration of the whole apparatus will be omitted.

In this image formation apparatus, a charging device 60, a developing device 61, and a photosensitive member cleaning device 63 that cleans a surface of the photosensitive member 40 are accommodated together in a cartridge 59 integrally with the photosensitive member 40. The cartridge 59 is attachable to and detachable from a rotating member supporting shaft, which is the photosensitive member engagement shaft 101.

At least one of the charging device 60, the developing device 61, and the photosensitive member cleaning device 63, instead of all of them together, may be integrally accommodated in the cartridge 59 with the photosensitive member 40.

According to this embodiment, services related to the image formation apparatus can be facilitated since the photosensitive member 40, and at least one of the charging device 60, the developing device 61, and the photosensitive member cleaning device 63 can be taken out of the apparatus together at once.

Figure 12:
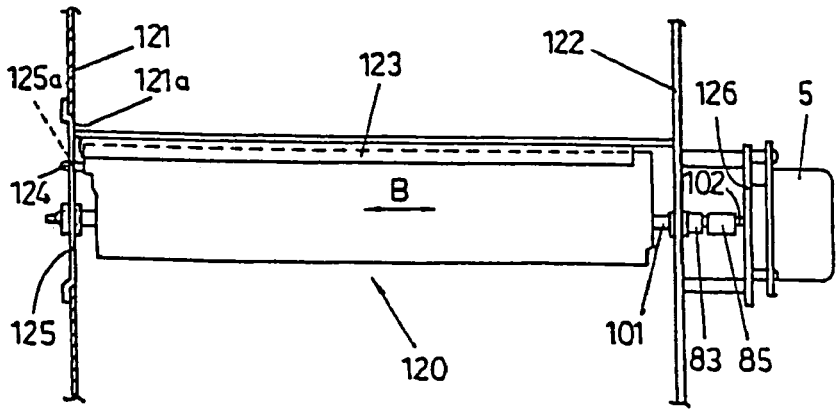
FIG. 12 is an illustration of a process cartridge according to still another embodiment of the present invention, which has been mounted to an image formation apparatus.
Figure 13:
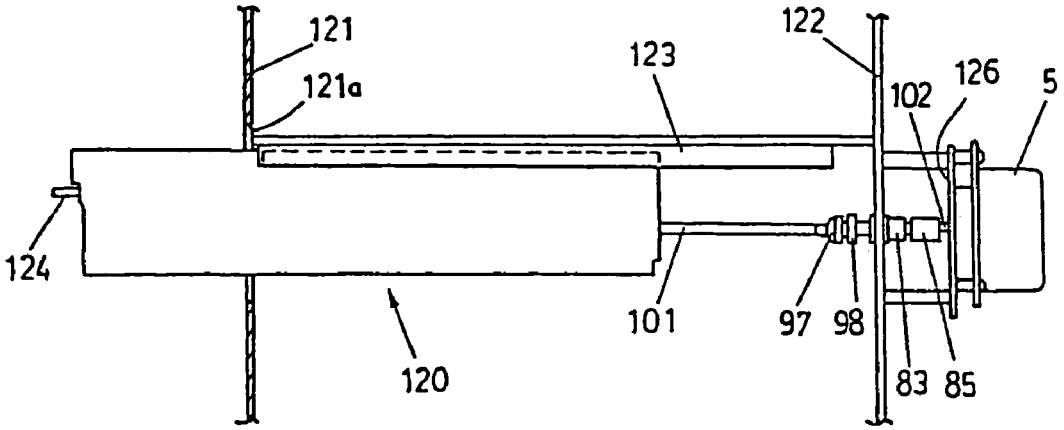
FIG. 13 is an illustration of the process cartridge being pulled out from the image formation apparatus.
Figure 14:
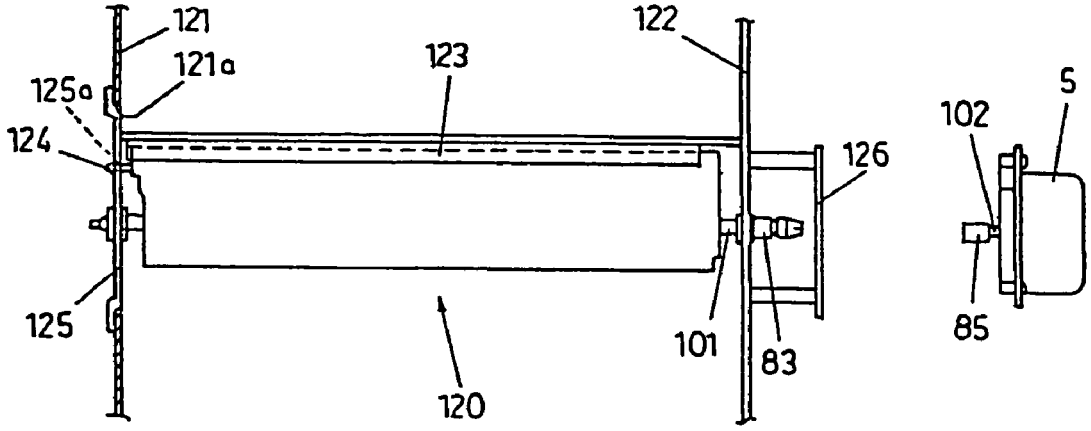
FIG. 14 is an illustration of a motor being separated from the process cartridge.

FIG. 12 is an illustration of a process cartridge according still another embodiment of the present invention which has been equipped in a copying machine. FIG. 13 is an illustration of the process cartridge that is being pulled out from the copying machine main body. FIG. 14 is an illustration of a motor that has been separated from the process cartridge. Parts corresponding to those of FIGS. 8 and 11 will be designated with the same reference numerals.

The process cartridge 120 is mounted in the color copying machine (the image formation apparatus) illustrated in FIG. 8 and accommodates at least one of the charging device 60, the developing device 61, and the photosensitive member cleaning device 63 integrally with the photosensitive member 40 (for each color). The process cartridge 120 is attachable to and detachable from the copying machine with the rotating member engagement shaft (rotating member supporting shaft) 101 being still attached to the copying machine.

An upper portion of the process cartridge 120 is engaged with a rail 123 fixed between apparatus main body frames 121 and 122, as illustrated in FIG. 12, and the process cartridge 120 is slidable in a direction indicated by an arrow B along which the process cartridge 120 is attached and detached.

The apparatus main body frame 121 has an opening 121*a* of a size allowing the process cartridge 120 to pass through, and a face plate 125 is attached to the opening 121*a* to be detachable relative to the apparatus main body frame 121.

An end of the process cartridge 120 on a right-hand side as shown in FIG. 13 of the process cartridge 120 is rotatably held at the rotating member engagement shaft 101 via a bearing 98 fixed integrally with the rotating member engagement shaft 101. Further, when the process cartridge 120 has been mounted in the copying machine as shown in FIG. 12, an end of the process cartridge 120 on a left-hand side of the process cartridge 120 is positioned such that a reference pin 124 projecting from the end on the left-hand side is fitted into an engagement hole 125*a* formed in the face plate 125 attached to the apparatus main body frame 121.

A method of replacing the process cartridges 120 will be explained next.

The face plate 125 fixed to the apparatus main body frame 121 as illustrated in FIG. 12 is released from the apparatus main body frame 121 by unfastening screws or the like. The process cartridge 120 is then moved leftward from the position shown in FIG. 12, and slid toward the front (leftward in FIG. 12) of the apparatus along the rail 123, as illustrated in FIG. 13.

Since the rotating member engagement shaft 101 which supports the process cartridge 120 is integrated with the rotating drive shaft 102 of the motor 5 fixed to the apparatus main body frame 122 by the shaft coupling device, the rotating member engagement shaft 101 remains with the apparatus main body frame 122 as the process cartridge 120 is slid away.

Accordingly, the process cartridge 120 is taken out of the copying machine with the rotating member engagement shaft 101 being drawn out of the process cartridge 120.

A method of replacing the motors 5 will be explained next.

All screws are removed from a motor mounting bracket 126 of the motor that has been mounted in the copying machine as shown in FIG. 12, and the male screw portion 83*c* of the grip member 83 and the female screw portion 85*a* of the grip force acting member 85 explained with reference to FIG. 1 and the like are screwed off from each other, such that the motor 5 can be removed, as illustrated in FIG. 14.

Unscrewing of the male screw portion 83*c* and the female screw portion 85*a* from each other is performed by rotating the rotating drive shaft 102 of the motor 5 or the grip force acting member 85 in a direction to which the male screw portion 83*c* and the female screw portion 85*a* are screwed away from each other while not rotating the rotating member engagement shaft 101.

According to the process cartridge 120, since the rotating member engagement shaft 101 and the rotating drive shaft 102 can be readily decoupled from each other in this manner, replacement of motors 5 can be easily carried out. Therefore, maintenance of the image formation apparatus can be facilitated.

Further, since the process cartridge 120 accommodates at least one of the charging device 60, the developing device 61, and the photosensitive member cleaning device 63 integrally with the photosensitive member 40, maintenance and thus services performed by a user can be facilitated.

A configuration of a shaft coupling device according to still another embodiment of the present invention will now be explained with reference to FIGS. 15 and 16. The shaft coupling device is for a photosensitive member provided in an image formation apparatus. Since parts other than the shaft coupling device are the same as those described with reference to FIGS. 6 to 8, explanation for the parts will be omitted.

Figure 15:
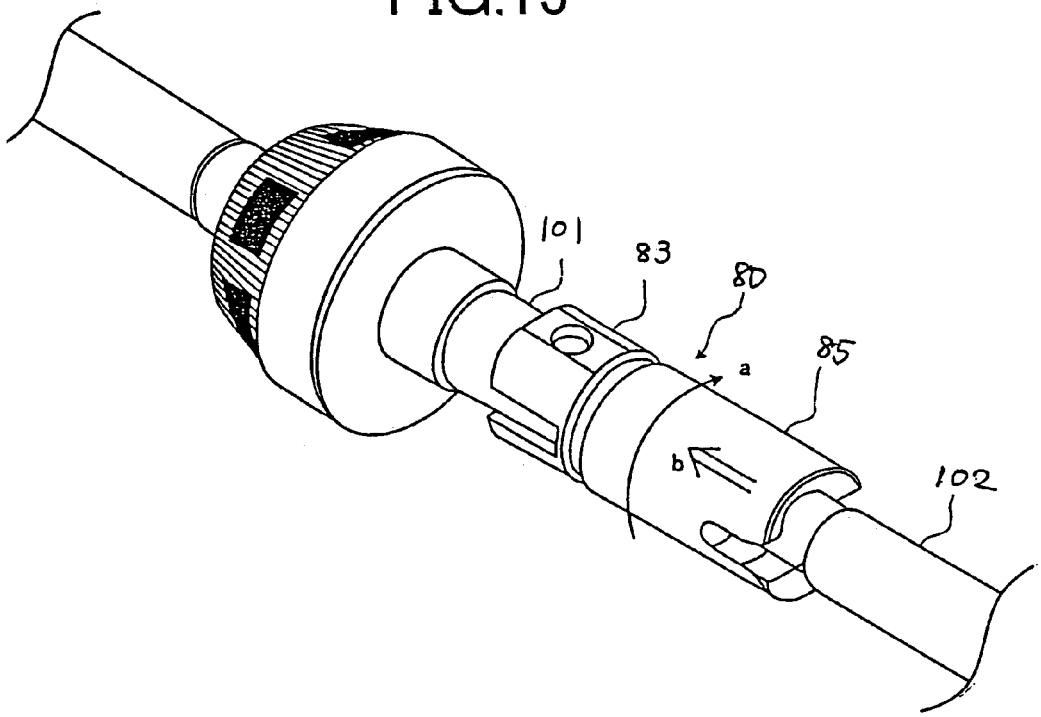
FIG. 15 is a perspective view of a shaft coupling device according to still another embodiment of the present invention.

As illustrated in FIG. 15, a photosensitive member 40 is provided with a first shaft which is a rotating member engagement shaft (a rotating shaft) 101 coupled to a second shaft which is a rotating drive shaft 102 provided in a motor (not illustrated) by a shaft coupling device 80. Of course, the first shaft may be the rotating drive shaft 102 and the second shaft may be the rotating member engagement shaft 101, instead.

As illustrated in FIG. 15, the shaft coupling device 80 includes a grip member 83 fixed to the rotating member engagement shaft 101 by a screw to be rotated integrally with the rotating member engagement shaft 101, and a grip force acting member 85 which moves in parallel with an axis of the rotating drive shaft 102 while rotating in an outer peripheral direction of a rotating member.

Figure 16:
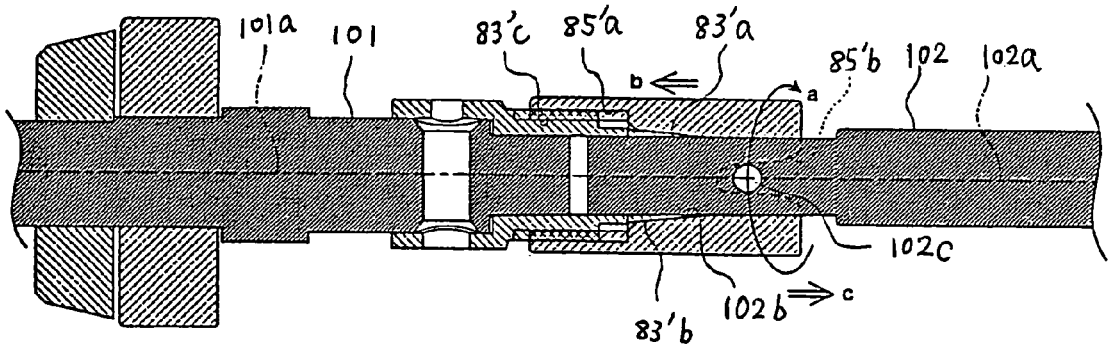
FIG. 16 is a sectional view of the shaft coupling device.

As illustrated in FIG. 16, the grip member 83 is formed with parallel surfaces 83'*a* parallel to a central axis 102*a* of the rotating drive shaft 102, and the parallel surfaces 83'*a* are positioned symmetrically relative to the central axis 102*a* of the rotating drive shaft 102.

Further, slanted surfaces 83'*b* are formed on an outer periphery of the grip member 83. When the grip force acting member 85 moves in a direction indicated by an arrow b, the grip force acting member 85 applies a pressure on the slanted surfaces 83'*b* of the grip member 83, so that the parallel surfaces 83'*a* are caused to abut on an outer peripheral surface 102*b* of the rotating drive shaft 102 by the pressure from the grip force acting member 85 to grip the rotating drive shaft 102.

As the grip force acting member 85 rotates along the outer periphery of the grip member 83 in a direction indicated by an arrow a, the grip force acting member 85 moves in the direction of arrow b. The grip member 83 and the grip force acting member 85 are threaded such that a forward rotating direction of the rotating drive shaft 102 and the direction indicated by the arrow a of the grip force acting member 85 coincide with each other. The grip member 83 is formed with a screw portion 83'*c* and the grip force acting member 85 is formed with a screw portion 85'*a* configured to engage with the screw portion 83'*c* of the grip member 83. Here, the forward rotating direction of the rotating drive shaft 102 is a direction in which the rotating drive shaft 102 rotates when the photosensitive member 40 is exposed by an exposing section 31.

Furthermore, the rotating drive shaft 102 has a projecting portion 102*c* projecting from the outer periphery of the rotating drive shaft 102. The grip force acting member 85 has a groove portion 85'*b* configured to mutually fit with the projecting portion 102*c*. When the grip force acting member 85 is caused to rotate, the projecting portion 102*c* of the rotating drive shaft 102 abuts on the groove portion 85'*b* of the grip force acting member 85 so that rotation of the grip force acting member 85 is limited.

Although the configuration of the shaft coupling device 80 has been explained in detail, in brief, the shaft coupling device 80 may be of a so-called collet chuck mechanism.

According to this embodiment, since the parallel surfaces 83'*a* formed on the grip member 83 rotating integrally with the rotating member engagement shaft 101 grips the rotating drive shaft 102, the rotating member engagement shaft 101 and the rotating drive shaft 102 are coupled to each other such that the central axis 101*a* and 102*a* are maintained to be coaxial, transmission accuracy of rotation can be improved. In particular, in the tandem type image formation apparatus in which toners of different colors are transferred onto each other on a sheet, the toners can be accurately superimposed due to the improved transmission accuracy of rotation, and thus image quality can be improved.

Further, when the grip force acting member 85 is moved in parallel with the axial center 102*a* of the rotating drive shaft 102, the rotating member engagement shaft 101 and the rotating drive shaft 102 are coupled with the central axes 101*a* and 102 being coaxial, so that the rotating member engagement shaft 101 and the rotating drive shaft 102 can be easily coupled to each other.

Furthermore, since the screw portion 83'*c* of the grip member 83 is engaged with the screw portion 85'*a* of the grip force acting member 85, the grip force acting member 85 is not caused to move in a direction indicated by an arrow c to which the rotating member engagement shaft 101 and the rotating drive shaft 102 are decoupled from each other. Accordingly, coupling of the rotating member engagement shaft 101 and the rotating drive shaft 102 can be ensured.

Moreover, since the forward rotating direction of the rotating drive shaft 102 coincides with the rotating direction a of the grip force acting member 85, when the rotating drive shaft 102 is rotated forward, that is, when the photosensitive member 40 is undergoing exposure, the grip force acting member 85 is prevented from rotating in the direction indicated by the arrow c to which the rotating member engagement shaft 101 and the rotating drive shaft 102 are decoupled from each other. As a result, the coupling of the rotating member engagement shaft 101 and the rotating drive shaft 102 can be even more ensured.

In addition, since the projecting portion 102*c* of the rotating drive shaft 102 is fitted into the groove portion 85'*b* of the grip force acting member 85, the grip force acting member 85 is prevented from rotating in the direction indicated by the arrow c to which c the rotating member engagement shaft 101 and the rotating drive shaft 102 are decoupled from each other. Consequently, the coupling of the rotating member engagement shaft 101 and the rotating drive shaft 102 can be still more ensured.

The present invention may be implemented in any apparatuses other than image formation apparatuses, for accurately coupling a shaft and another shaft together to provide the shafts as an integral structure, with central axes of the shafts precisely coinciding with each other.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A shaft coupling device which couples a first shaft and a second shaft together, comprising:

a grip unit to be attached to the first shaft and including a grip portion configured to grip the second shaft, the grip portion having an end with a plurality of grip portions forming notches of a length being parallel with an axial direction of the first shaft; and a grip force acting unit to be attached to the second shaft and configured to cause a grip force for gripping the second shaft to act on the grip portion by moving each of said grip portions in a radial direction towards the second shaft, wherein the grip force acting unit and the grip unit can be screwably engaged with each other such that a tightening of the screwable engagement causes the plurality of the grip portions to move radially towards the second shaft.

2. The shaft coupling device according to claim 1, wherein the grip unit is detachably attached to the first shaft.

3. The shaft coupling device according to claim 1, wherein the grip force acting unit causes the grip force to act on the grip portion by abutting on the grip portion to move the grip portion in the radial direction when the grip force acting unit is moved toward the grip unit.

4. A shaft coupling device which couples a first shaft and a second shaft together, comprising:

a grip unit to be attached to the first shaft and including a grip portion configured to grip the second shaft, the grip portion having an end with a plurality of grip portions forming notches of a length being parallel with an axial direction of the first shaft; and a grip force acting unit to be attached to the second shaft and configured to cause a grip force for gripping the second shaft to act on the grip portion by moving each of said grip portions in a radial direction towards the second shaft, wherein the grip portion and the first shaft are one piece.

5. A shaft coupling device which couples a first shaft and a second shaft together, comprising:

a grip unit to be attached to the first shaft and including a grip portion configured to grip the second shaft, the grip portion having an end with a plurality of grip portions forming notches of a length being parallel with an axial direction of the first shaft; and a grip force acting unit to be attached to the second shaft and configured to cause a grip force for gripping the second shaft to act on the grip portion by moving each of said grip portions in a radial direction towards the second shaft, wherein the first shaft and the second shaft have end portions, the end portions being coupled to each other and respectively inserted into a shaft center holding portion configured to hold the first shaft and the second shaft coaxially to each other, and wherein the shaft center holding portion is positioned at a distance away from a tip of the end of the grip portion, the distance being greater than the length of the notches.

6. The shaft coupling device according to claim 5, wherein the shaft center holding portion is a portion of the grip unit.

7. A shaft coupling device which couples a first shaft and a second shaft together, comprising:

a grip unit to be attached to the first shaft and including a grip portion configured to grip the second shaft, the grip portion having an end with a plurality of grip portions forming notches of a length being parallel with an axial direction of the first shaft; and a grip force acting unit to be attached to the second shaft and configured to cause a grip force for gripping the second shaft to act on the grip portion by moving each of said grip portions in a radial direction towards the second shaft, wherein the grip force acting unit causes the grip force to act on the grip portion by abutting on the grip portion to move the grip portion in the radial direction when the grip force acting unit is moved toward the grip unit, and the grip force acting unit and the grip unit include screw portions, and the grip force acting unit moves toward the grip unit when the screw portions are screwed onto each other.

8. A shaft coupling device which couples a first shaft and a second shaft together, comprising:

a grip unit to be attached to the first shaft and including a grip portion configured to grip the second shaft, the grip portion having an end with a plurality of grip portions forming notches of a length being parallel with an axial direction of the first shaft; and a grip force acting unit to be attached to the second shaft and configured to cause a grip force for gripping the second shaft to act on the grip portion by moving each of said grip portions in a radial direction towards the second shaft, wherein the grip force acting unit causes the grip force to act on the grip portion by abutting on the grip portion to move the grip portion in the radial direction when the grip force acting unit is moved toward the grip unit, and a contacting portion of the grip unit at which the grip unit contacts the grip force acting unit is tapered, and the grip force acting unit abuts on the contacting portion to move the grip portion in the radial direction when the grip force acting unit is moved toward the grip unit.

9. A shaft coupling device which couples a first shaft and a second shaft together, comprising:

a grip unit to be attached to the first shaft and including a grip portion configured to grip the second shaft, the grip portion having an end with notches of a length being parallel with an axial direction of the first shaft; and a grip force acting unit to be attached to the second shaft and configured to cause a grip force for gripping the second shaft to act on the grip portion by moving the grip portion in a radial direction of the second shaft;

wherein the grip force acting unit is a clamp member configured to fasten the grip portion from around substantially an entire outer periphery of the grip portion.

10. A shaft coupling device that couples a first shaft and a second shaft, comprising:

a grip unit including a parallel surface parallel with a central axis of the first shaft and configured to grip the second shaft by abutting the parallel surface on the second shaft; and a grip force acting unit configured to cause a grip force for gripping the second shaft to act on the parallel surface, wherein the grip force acting unit moves along an outer peripheral surface of the grip unit in parallel with a central axis of the second shaft to change a pressure acting on the grip unit, the parallel surface of the grip unit is caused to abut on an outer peripheral surface of the second shaft by the pressure to grip the second shaft, and wherein the grip force acting unit and the grip unit can be screwably engaged with each other such that a tightening of the screwable engagement causes the plurality of the grip portions to move radially towards the second shaft.

11. The shaft coupling device according to claim 10, wherein one of the first shaft and the second shaft is a rotating member supporting shaft configured to support a rotating member and another one of the first shaft and the second shaft is an output shaft of a motor configured to rotate the rotating member supporting shaft.

12. A shaft coupling device that couples a first shaft and a second shaft, comprising:

a grip unit including a parallel surface parallel with a central axis of the first shaft and configured to grip the second shaft by abutting the parallel surface on the second shaft; and a grip force acting unit configured to cause a grip force for gripping the second shaft to act on the parallel surface, wherein the grip force acting unit moves along an outer peripheral surface of the grip unit in parallel with a central axis of the second shaft to change a pressure acting on the grip unit, the parallel surface of the grip unit is caused to abut on an outer peripheral surface of the second shaft by the pressure to grip the second shaft, one of the first shaft and the second shaft is a rotating member supporting shaft configured to support a rotating member and another one of the first shaft and the second shaft is an output shaft of a motor configured to rotate the rotating member supporting shaft, and the grip force acting unit rotates around and moves in parallel with the central axis of the output shaft as the grip force acting unit is screwed onto the grip unit.

13. The shaft coupling device according to claim 12, wherein the grip force acting unit is rotated in the same direction as a forward rotating direction of the output shaft when the grip force acting unit is screwed onto the grip unit, such that the pressure acting on the grip unit is increased.

14. The shaft coupling device according to claim 12, wherein the output shaft includes a projecting portion on an outer periphery of the output shaft, and the grip force acting unit includes a groove portion configured to fit with the projecting portion.

15. An image formation apparatus comprising:

a rotating member supporting shaft configured to support a rotating member;

an output shaft of a motor configured to rotate the rotating member supporting shaft; and a shaft coupling device configured to couple the rotating member supporting shaft and the output shaft, and includes a grip unit having a grip portion to be attached to one of the rotating member supporting shaft and the output shaft to grip a remaining shaft of the rotating member supporting shaft and the output shaft wherein the grip portion has an end with a plurality of split grip portions forming notches of a length being parallel with an axial direction of the output shaft, and a grip force acting unit to be attached to the remaining shaft to cause a grip force for gripping the remaining shaft to act on the grip portion by moving the grip portion in a radial direction of the remaining shaft wherein said grip force acting unit comprises a clamp member configured to fasten the grip portion from around substantially an entire outer periphery of the grip portion.

16. The image formation apparatus according to claim 15, wherein the rotating member supporting shaft includes a rotating engagement member integrated with the rotating member supporting shaft and engaged with the rotating member to rotate integrally with the rotating member, and a bearing that rotatably supports the rotating member supporting shaft, and the rotating member is attachable to and detachable from the rotating member supporting shaft.

17. The image formation apparatus according to claim 15, wherein the rotating member is a drum-shaped photosensitive member.

18. The image formation apparatus according to claim 17, comprising a plurality of the photosensitive member.

19. The image formation apparatus according to claim 17, further comprising a structural unit including the photosensitive member integrally assembled with at least one of a charging device, a developing device, and a cleaning device for cleaning a surface of the photosensitive member, and being attachable to and detachable from the rotating member supporting shaft.

20. The image formation apparatus according to claim 15, wherein the rotating member is a belt supporting member that supports a belt so as to allow conveyance of the belt.

21. The image formation apparatus according to claim 15, wherein the motor is of a direct driving type not having a reduction mechanism.

22. The image formation apparatus according to claim 15, wherein the motor includes a planetary roller reduction mechanism.

23. The image formation apparatus according to claim 15, further comprising a process cartridge, the process cartridge includes:

a photosensitive member which is integrally assembled with at lest one of a charging device a developing device, and a cleaning device for cleaning a surface of the photosensitive member, wherein the photosensitive member is attachable to and detachable from the image formation apparatus when the rotating member supporting shaft is still attached to the image formation apparatus.

24. The image formation apparatus according to claim 15, wherein the rotating member comprises:

a belt unit which includes a belt;

a belt supporting member configured to support the belt so as to allow conveyance of the belt;

a rotating member supporting shaft configured to support the rotating member; and an output shaft of a motor configured to rotate the rotating member supporting shaft.

25. An image formation apparatus comprising:

a rotating member supporting shaft configured to support a rotating member;

an output shaft of a motor configured to rotate the rotating member supporting shaft; and a shaft coupling device configured to couple the rotating member supporting shaft and the output shaft, and includes a grip unit including a parallel surface parallel with a central axis of the output shaft and configured to grip the rotating member supporting shaft by abutting the parallel surface on the rotating member supporting shaft, and a grip force acting unit configured to cause a grip force gripping the rotating member supporting shaft to act on the parallel surface, wherein the grip force acting unit moves along an outer peripheral surface of the grip unit in parallel with a central axis of the output shaft to change a pressure acting on the grip unit, and the parallel surface of the grip unit is caused to abut on an outer peripheral surface of the rotating member supporting shaft by the pressure to grip the rotating member supporting shaft.

26. The shaft coupling device according to claim 25, wherein the grip force acting unit rotates around and moves in parallel with the central axis of the output shaft as the grip force acting unit is screwed onto the grip unit.

27. The shaft coupling device according to claim 26, wherein the grip force acting unit is rotated in the same direction as a forward rotating direction of the output shaft when the grip force acting unit is screwed onto the grip unit, such that the pressure acting on the grip unit is increased.

28. The shaft coupling device according to claim 25, wherein the output shaft includes a projecting portion on an outer periphery of the output shaft, and the grip force acting unit includes a groove portion configured to fit with the projecting portion.

* * * * *